US008895092B1

(12) United States Patent
Field et al.

(10) Patent No.: US 8,895,092 B1
(45) Date of Patent: Nov. 25, 2014

(54) PACKAGE INCLUDING A THERMOPLASTIC TRAY

(71) Applicant: Cryovac Inc., Duncan, SC (US)

(72) Inventors: Morris John Field, Poole (GB); Stefano Capitani, Como (IT); Christoforos Chrysanthidis, Milan (IT)

(73) Assignee: Cryovac, Inc., Duncan, SC (US)

( * ) Notice: Subject to any disclaimer, the term of this patent is extended or adjusted under 35 U.S.C. 154(b) by 0 days.

(21) Appl. No.: 14/076,349

(22) Filed: Nov. 11, 2013

Related U.S. Application Data

(62) Division of application No. 12/997,753, filed on Mar. 16, 2011, now Pat. No. 8,642,102.

(51) Int. Cl.
*B65B 25/06* (2006.01)
*B65D 1/36* (2006.01)

(52) U.S. Cl.
CPC .. *B65D 1/36* (2013.01); *B65B 25/06* (2013.01)
USPC ..... 426/129; 426/118; 426/396; 426/404; 426/418; 426/106; 220/656; 220/657; 220/658; 220/659; 220/790; 220/639; 220/640; 220/641; 220/642; 220/644; 220/557; 220/564; 220/608; 220/675; 220/674; 220/671; 220/670; 229/407; 206/557; 206/564; 206/497

(58) Field of Classification Search
CPC ..... B65D 2543/00694; B65D 2543/00704; B65D 1/34; B65D 1/36; B65D 1/44
USPC ..... 220/656–59, 790, 639–644, 608, 675, 220/674, 671, 670; 206/557, 564, 497; 229/407; D7/554.3, 550.1; D9/425, D9/432
See application file for complete search history.

(56) References Cited

U.S. PATENT DOCUMENTS

| | | | | | |
|---|---|---|---|---|---|
| 3,357,625 | A | * | 12/1967 | Malmgren | 229/407 |
| 3,447,714 | A | * | 6/1969 | Elliot | 206/1.5 |
| D223,144 | S | * | 3/1972 | Bloch | D9/761 |
| 3,718,274 | A | * | 2/1973 | Reifers et al. | 229/407 |
| 3,833,742 | A | * | 9/1974 | Whetmore et al. | 426/129 |

(Continued)

FOREIGN PATENT DOCUMENTS

| | | |
|---|---|---|
| EP | 0690012 A1 | 1/1996 |
| GB | 961595 | 6/1964 |
| NL | 294226 | 4/1965 |

*Primary Examiner* — Rena L Dye
*Assistant Examiner* — William Kuduk
(74) *Attorney, Agent, or Firm* — Ashley D. Wilson

(57) ABSTRACT

A package including a tray (10) provided with a base (11), a plurality of sidewalls (12, 13, 14, 15) extending upwardly and slightly outwardly from said base (11), a primary flange (20) integrally joined to the upper edges of the sidewalls (12, 13, 14, 15) and extending outwardly all around the upper periphery of the sidewalls (12, 13, 14, 15), a rim (21), i.e., a downward flap extending downwardly and tapering slightly outwardly from the outer periphery of the primary flange (20), and a secondary flange (22), i.e., an overhanging portion extending outwardly from the lower edge of the rim (21), said tray being characterized in that a plurality of strengthening ribs (23) extend substantially vertically along the rim (21) and outwardly with respect to the tray body. The trays (10) according to the present invention have an improved rigidity and improved resistance to deformation and bending, improvements that have been achieved without increasing the amount of plastic material used for the manufacture of the tray (10) but relying only on a specific geometry thereof.

18 Claims, 5 Drawing Sheets

(56) References Cited

U.S. PATENT DOCUMENTS

| | | | | | |
|---|---|---|---|---|---|
| D235,302 | S | * | 6/1975 | Lanigan | D7/584 |
| 4,055,672 | A | * | 10/1977 | Hirsch et al. | 426/127 |
| 4,692,195 | A | * | 9/1987 | Allen et al. | 156/98 |
| 4,742,934 | A | * | 5/1988 | Michaud et al. | 220/784 |
| 4,910,033 | A | * | 3/1990 | Bekele et al. | 426/129 |
| 5,018,623 | A | * | 5/1991 | Hrenyo | 206/557 |
| D378,180 | S | * | 2/1997 | Hayes et al. | D7/554.1 |
| D414,409 | S | * | 9/1999 | Sanfilippo et al. | D9/761 |
| 5,984,130 | A | * | 11/1999 | Hayes et al. | 220/574 |
| 6,032,827 | A | * | 3/2000 | Zettle et al. | 220/788 |
| D432,914 | S | * | 10/2000 | Hayes et al. | D9/434 |
| 6,168,044 | B1 | * | 1/2001 | Zettle et al. | 220/784 |
| 6,257,401 | B1 | * | 7/2001 | Mangla et al. | 206/204 |
| 6,430,467 | B1 | * | 8/2002 | D'Amelio et al. | 700/213 |
| 6,572,909 | B1 | * | 6/2003 | Bagwell et al. | 426/394 |
| D489,254 | S | * | 5/2004 | Kocis et al. | D9/425 |
| D496,560 | S | * | 9/2004 | Lerner | D7/629 |
| 7,063,231 | B2 | * | 6/2006 | Stanos et al. | 220/793 |
| D542,128 | S | * | 5/2007 | Gross et al. | D9/429 |
| D551,975 | S | * | 10/2007 | Gomoll et al. | D9/452 |
| D556,569 | S | * | 12/2007 | Stein et al. | D9/428 |
| D577,995 | S | * | 10/2008 | Lovett | D9/425 |
| 7,661,528 | B2 | * | 2/2010 | Vovan et al. | 206/508 |
| 7,823,746 | B1 | * | 11/2010 | McCumber | 220/780 |
| D671,403 | S | * | 11/2012 | Ronan et al. | D9/427 |
| D684,466 | S | * | 6/2013 | Wichmann | D9/432 |
| D689,334 | S | * | 9/2013 | Krueger et al. | D7/538 |
| 2002/0020709 | A1 | * | 2/2002 | Huang et al. | 220/675 |
| 2003/0108643 | A1 | * | 6/2003 | Hornsby et al. | 426/129 |
| 2007/0020362 | A1 | * | 1/2007 | D'Amelio et al. | 426/129 |
| 2008/0085345 | A1 | * | 4/2008 | Mabry | 426/129 |
| 2008/0118609 | A1 | * | 5/2008 | Harlfinger | 426/106 |
| 2008/0160143 | A1 | * | 7/2008 | Edwards et al. | 426/129 |
| 2009/0145908 | A1 | * | 6/2009 | Vovan | 220/575 |

* cited by examiner

PACKAGE INCLUDING A THERMOPLASTIC TRAY

CROSS REFERENCE TO RELATED APPLICATIONS

The present application is a divisional of U.S. patent application Ser. No. 12/997,753, now U.S. Pat. No. 8,642,102, filed Mar. 16, 2011, which is a National Stage Application of international patent application PCT/EP09/04125, filed Jun. 8, 2009, and in turn claims priority to EP08010965.5 filed on Jun. 17, 2008. The entire content of each referenced application is incorporated by reference herein.

FIELD OF THE INVENTION

The present invention relates to an improved thermoplastic tray. In particular, to an improved thermoformed plastic solid tray useful for the packaging of, i.e., food products. More particularly the present invention refers to a thermoformed plastic solid (i.e., not foamed) tray for food and non-food products, endowed with improved rigidity and resistance to deformation and bending, due to its particular geometry.

BACKGROUND

Packaging trays are widely used at the retail level, particularly in connection with the packaging of food products. Products, such as meat, are typically packaged in trays, either pre-made or thermoformed in-line in a continuous web of thermoplastic material. Said trays are then closed by means of a flexible lid, which is sealed thereto, to guarantee the package hermeticity, and, in case of in-line thermoformed tray, the end packages are finally separated from the continuous web. In this type of packaging a continuous objective is to reduce the thickness of the plastic packaging material used for the trays, for both cost and environmental reasons. This objective however needs to be reached while still providing trays that are resistant to deformation during the industrial high speed packaging processes, as any deformation of the tray does jeopardize the hermeticity of the seal, and that do not bend when the end package is grasped and lifted, as this may prejudice safe handling at any step of the distribution chain. With the solid trays actually on the market and in particular with the in-line thermoformed trays, this is often a problem, and in particular it is a real and serious problem when the lid which is sealed to the tray is a heat-shrinkable film as the shrinkage of the lid in the packaging process will exert a certain shrink force on the tray walls and increase the risk of deformation and/or bending. A manner known to increase the rigidity of a tray without increasing its thickness is to add to the polymer material used for the manufacture of the tray an inorganic fill. This however would lead to opaque trays while the current trend is for transparent trays, as this would allow the customers to visually inspect the product they are buying from all sides and somehow guarantee their quality.

Accordingly there is still a need in the art for a thermoplastic solid tray, which may be available also as a transparent tray, endowed with an improved rigidity and improved resistance to deformation and bending, where these improvements are achieved without increasing the amount of plastic material used for its manufacture but relying on a specific geometry thereof.

SUMMARY

A first object of the present invention is a solid thermoformed plastic tray which is provided with a base, a plurality of sidewalls extending upwardly and slightly outwardly from said base, a primary flange integrally joined to the upper edges of the sidewalls and extending outwardly all around the upper periphery of the sidewalls, a rim, i.e., a downward flap extending downwardly and tapering slightly outwardly from the outer periphery of the primary flange, and a secondary flange, i.e., an overhanging portion extending outwardly from the lower edge of the rim, said tray being characterized in that a plurality of strengthening ribs extend substantially vertically along the rim and outwardly with respect to the tray body.

In a preferred embodiment said strengthening ribs along the rim are not present in correspondence to the median line of each of the sidewalls. In one embodiment they are in an even number and, in each pair of opposed sidewalls, are symmetrically disposed with respect to the median line thereof.

In a preferred embodiment of the tray according to the present invention, strengthening ribs are also present along the tray sidewalls.

In a most preferred embodiment of the tray according to the present invention, strengthening ribs are also present in at least part of the tray base surface.

In a preferred embodiment said solid tray is transparent.

A second object of the present invention is a package comprising a tray of the first object, a product loaded in the tray, and a lid sealed to the tray to enclose the product.

In a preferred embodiment said lid is sealed to the tray flange.

In one embodiment a heat-shrinkable film is used as the lidding film.

In another embodiment a combination of two different films, an innermost oxygen permeable film and an outermost oxygen barrier film, is used to lid the tray. Preferably in said embodiment at least one of said oxygen permeable and said oxygen barrier films is heat-shrinkable. More preferably in said embodiment both films are heat-shrinkable.

In a preferred embodiment the lid has oxygen barrier properties and the atmosphere within the package is suitably selected to prolong or improve the shelf-life of the packaged product.

A third object of the present invention is a process for the manufacture of the solid tray of the first object starting from a suitably selected mono- or multi-layer thermoplastic sheet by conventional thermoforming processes.

A fourth object is a packaging process where a solid tray of the first object is thermoformed in-line in a continuous web of thermoplastic material, the tray is loaded with the product to be packaged, the package is closed by a lidding film and the end packages are then separated by cutting through the continuous webs.

In one embodiment the lidding film comprises an oxygen barrier film and the atmosphere within the package is suitably selected to prolong or improve the shelf-life of the packaged product. In a preferred embodiment the lidding film comprises an innermost gas-permeable flexible film and an outermost gas-barrier flexible film and preferably at least one of said oxygen permeable and oxygen barrier flexible films is heat-shrinkable.

DETAILED DESCRIPTION

The present invention will be described in more detail in the following by making reference to the accompanying drawings, where identical numerals refer to identical parts, in which some of the embodiments of the present invention are illustrated.

Figure 1:
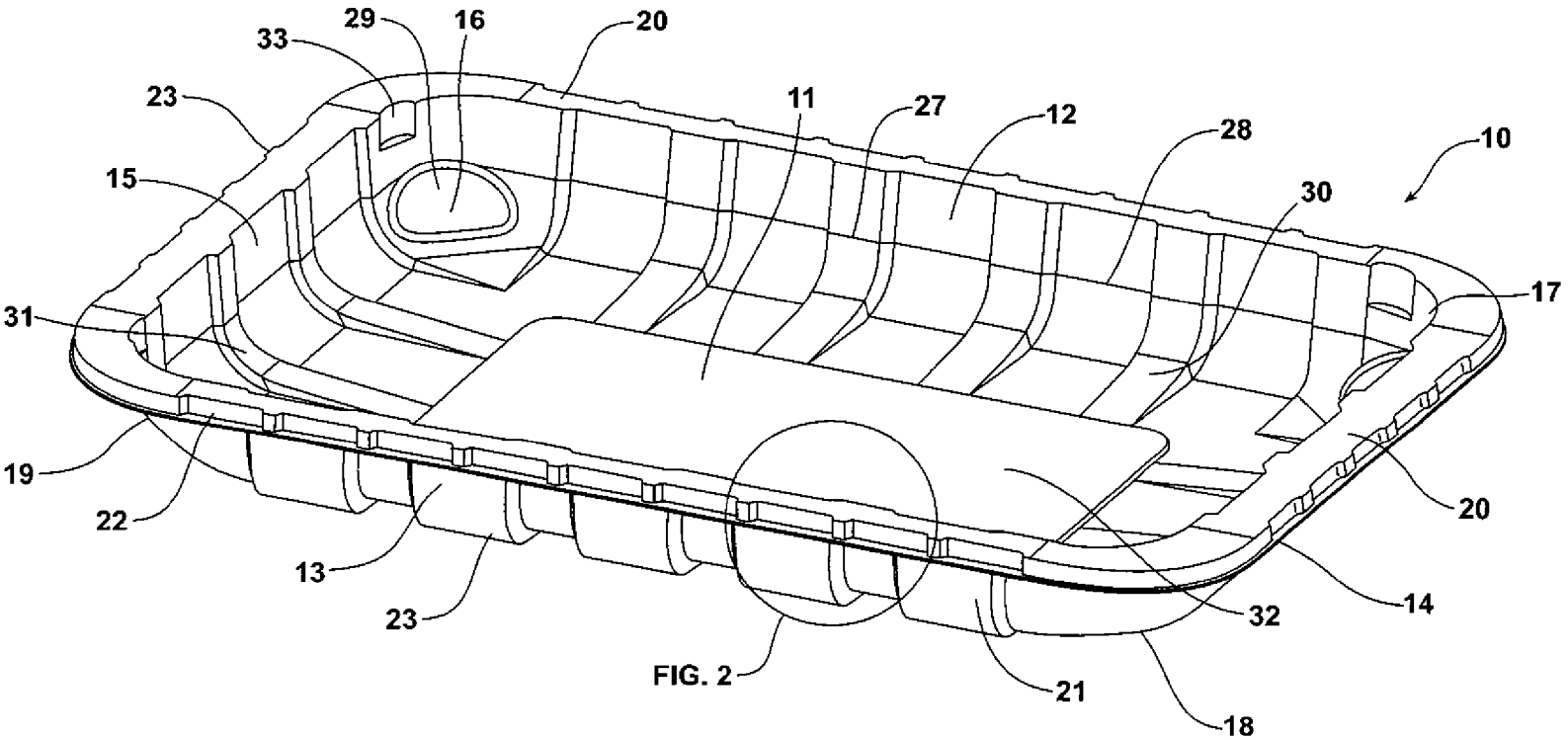
FIG. 1 is a perspective view of one embodiment of the tray of the present invention.

FIG. 1 illustrates a thermoplastic solid tray 10 comprising a base 11, and four sidewalls. In this embodiment the base 11 has a substantially rectangular shape and the tray comprises two longitudinal sidewalls 12 and 13 that are almost parallel and positioned one opposite to the other, and are joined by two opposed shorter side- or end-walls 14 and 15. These sides 12 to 15 extend upwardly and tapering slightly outwardly from the periphery of the base or bottom 11 (preferably with a draft angle of up to 7 degrees, more preferably in the range 2 degrees to 6 degrees), and rounded corners 16 to 19 are present in the areas of junction between two consecutive sides. A primary flange 20 projects outwardly from the top edge of the sidewalls and extends along each sidewall of the tray body, including the round corners. Said primary flange is preferably flat to facilitate heat-sealing of the flexible lid thereon, but it can also be slightly curved. From the primary flange outer periphery, a rim 21 extends downwardly, tapering slightly outwardly, and from the lower edge of the rim 21 a secondary flange 22, extends outwardly, typically parallel to the primary one. Strengthening ribs 23 are present on said rim 21, along the side walls 12 to 15, in the external part thereof.

Figure 5:
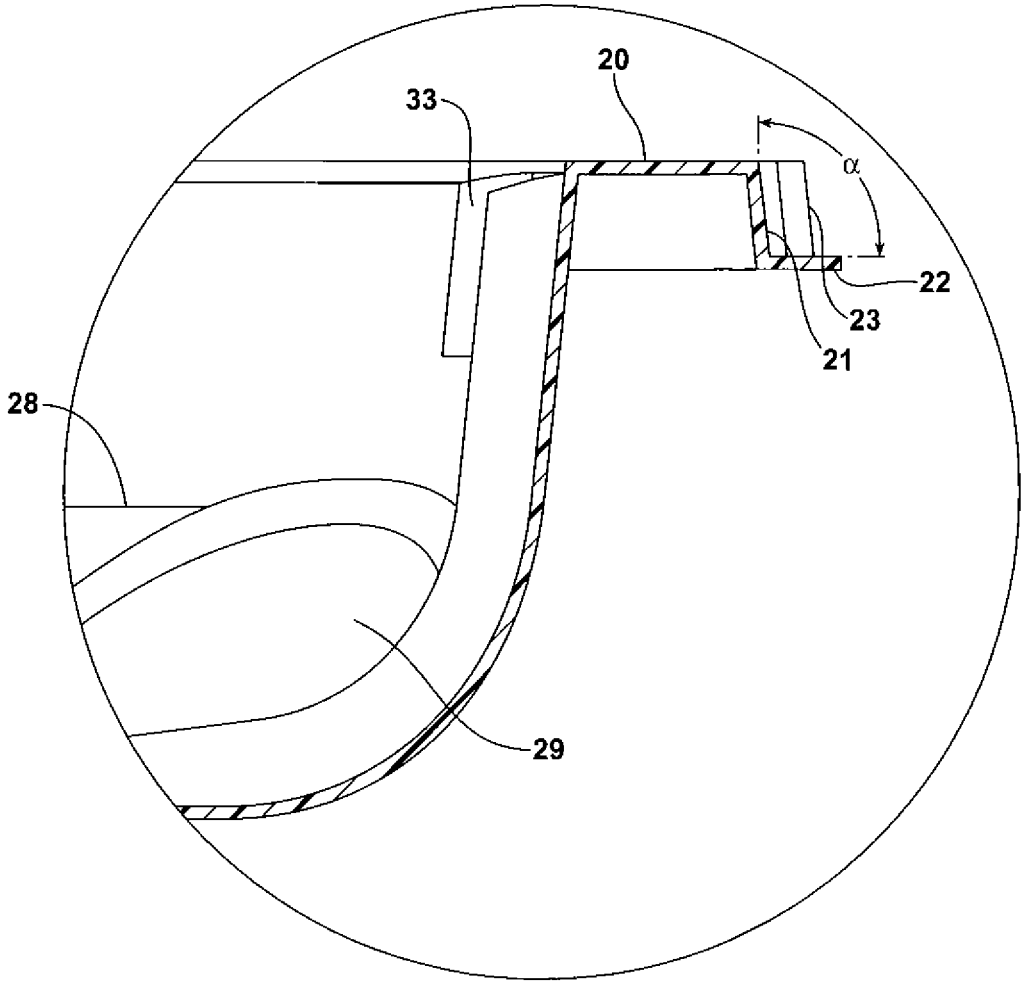
FIG. 5 shows a magnified view of the circled region of FIG. 4.

As illustrated in FIG. 5, the angle $\alpha$ between the primary flange and the rim (from horizontal level) is typically comprised between 75 degrees and <90 degrees, as an angle of 90 degrees would be a problem in the forming process, in particular in removing the formed tray from the mold, in stacking consecutive trays during the thermoforming process and in separating stacked trays for the filling and sealing process, while angles smaller than 75 degrees may decrease the stiffening effect of the ribs on the rim. Preferably said angle is maintained between 77 degrees and 87 degrees more preferably between 79 degrees and 86 degrees, even more preferably between 81 degrees and 85 degrees.

The strengthening ribs 23 extend all along the length of the rim, i.e. from the primary flange to the secondary flange. They are preferably in an even number on each sidewall and symmetrically positioned with respect to the median lines joining opposed sidewalls. In the embodiment illustrated in FIG. 1, that represents a standard rectangular tray, that may be for instance, 260×177, 232×146, or 179×139 mm (length×width) in size, there are four ribs 23 on the rim along each of the short sidewalls and eight ribs 23 on the rim along each of the longitudinal sidewalls. The above sizes are those standard sizes more commonly employed for solid trays but other sizes are of course possible, bearing in mind however that an increase in size of the tray generally brings about an increase in the weight of the packaged product and therefore an increased risk of deformation of the tray when the package is grasped and lifted. The numbers given above however are not fixed and actually the number of ribs 23, along each sidewall, will depend on the length of the sidewall and thus on the size of the tray, and on the dimensions of the ribs themselves. In the embodiment illustrated in FIG. 1 the ribs are positioned at the same distance one from the other. However it is not at all necessary that they are at the same distance but for instance along each of the sidewalls the distance between two consecutive ribs may increase starting from the end of the sidewalls close to the round corners toward the median line and then, symmetrically, decrease starting from the median line to the opposite ends of the sidewalls considered.

Figure 2:
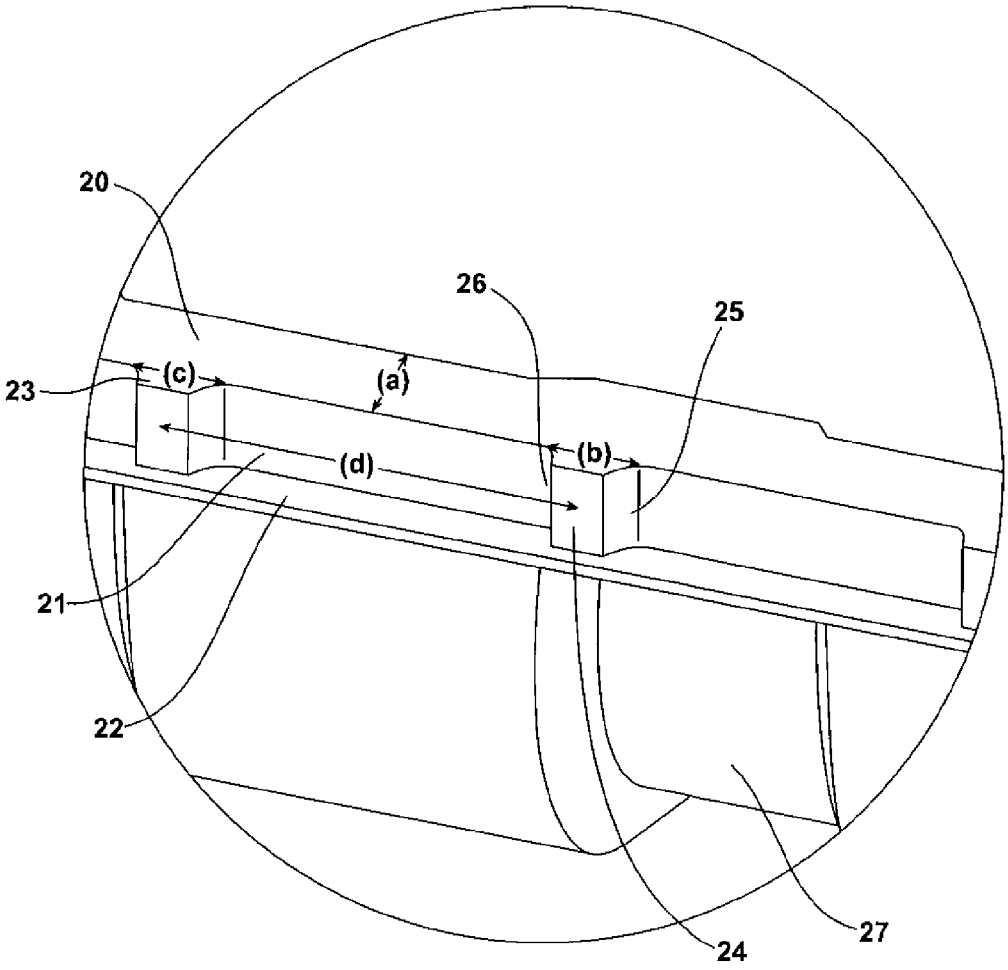
FIG. 2 shows a magnified view of the circled region of FIG. 1.

As illustrated in the embodiment of FIG. 1, and in more detail in FIG. 2, the ribs 23 are vertically disposed along the rim 21. In said embodiment, they have the same shape, a sort of trapezoidal shape with the minor base 24 outwardly and the sides 25 and 26 not exactly straight but somehow rounded, to facilitate removal of the tray from the mold. In the embodiment illustrated in FIG. 1, the same section/shape is maintained all along the length of the rib. In line of principle however the strengthening ribs 23 not necessarily need to have the same shape nor do they necessarily need to have the same section all along their length, provided however that once the tray is thermoformed it can be easily removed from the mold. Thus in any case the part of each rib closer to the secondary flange, if not of the same size as the part closer to the primary flange, should be larger to guarantee that the trays can then be removed from the mold without any effort and without stretching the rim and secondary flange material. In a preferred embodiment however all the ribs 23 have the same shape and section, and the same section is maintained all along the length in each rib 23. Such a configuration will ease the manufacture of the tray by thermoforming, will make the stiffening effect more pronounced, and will also give a better appearance to the tray. The length of the ribs 23, that correspond to the length of the rim 21, is at least 2 mm, preferably at least 3 mm, and more preferably at least 4 mm. Preferably the length of the rim 21 is maintained below 10 mm, more preferably below 9 mm, and even more preferably below 8. A length of the rim 21, as well as of the ribs 23, between 4 and 7 mm, e.g. 5-6 mm, is thus preferred.

In trays of the dimensions indicated above, the width of the primary flange, indicated with (a) in FIG. 2, meaning with that the shortest distance between a point on the innermost edge and one on the outermost edge of said primary flange, will typically be at least 2 mm, preferably at least 3 mm, more preferably at least 4 mm, and even more preferably at least 5 mm, to allow the provision of an hermetically sealed package by means of a conventional heat-sealing of the lidding film on said flange. Generally the primary flange is not more than 13 mm wide, preferably not more than 12 mm, and even more preferably not more than 10 mm, just to save on the amount of plastic material employed. Typical values are comprised between 4 and 8 mm. The thickness of the ribs 23, indicated with (b) in FIG. 2, and meaning with that how much the rib protrudes beyond the outermost edge of the primary flange along the sidewalls, is at least 0.5 mm, but preferably at least 1 mm, and even more preferably at least 1.5 mm, e.g. 2.0 or 2.5 mm. Also in this case economic considerations suggest keeping the thickness of the ribs 23 below 5 mm, preferably below 4 mm and even more preferably below 3 mm. The width of the ribs 23, indicated in FIG. 2 as (c), will mainly depend on the dimensions of the tray and the number of ribs present on the flange. Typically it should be comprised between 2 and 12 mm, preferably between 2.5 and 11 mm, and even more preferably between 3 and 10 mm. Preferably the width (c) of the ribs 23 should be as low as possible, compatible however with an acceptable manufacturing process. A preferred width would thus be comprised between 3 and 8 mm, e.g., 4 to 6 mm. The distance between two consecutive ribs, indicated in FIG. 2 as (d) is typically comprised between 6 and 30 mm, preferably between 7 and 27 mm, even more preferably between 8 and 24 mm, and even more preferably between 9 and 21 mm. Thus on the primary flange of the long sidewalls of a tray sized, e.g., 260×177 mm, there can be from 6 to almost 30 ribs 23, typically from 6 to 20, preferably 7 to 16, and even more preferably 8 to 14.

The secondary flange 22 will have a width going from about 1 mm, in correspondence with the ribs 23, to about 5 mm, in correspondence with the indentations between two consecutive ribs 23. Preferably in correspondence with the ribs 23 it will be at least 1.1 mm, more preferably at least 1.3 mm and even more preferably at least 1.5 mm. The width in correspondence with the indentations will then depend on the thickness of the ribs.

Figure 3:
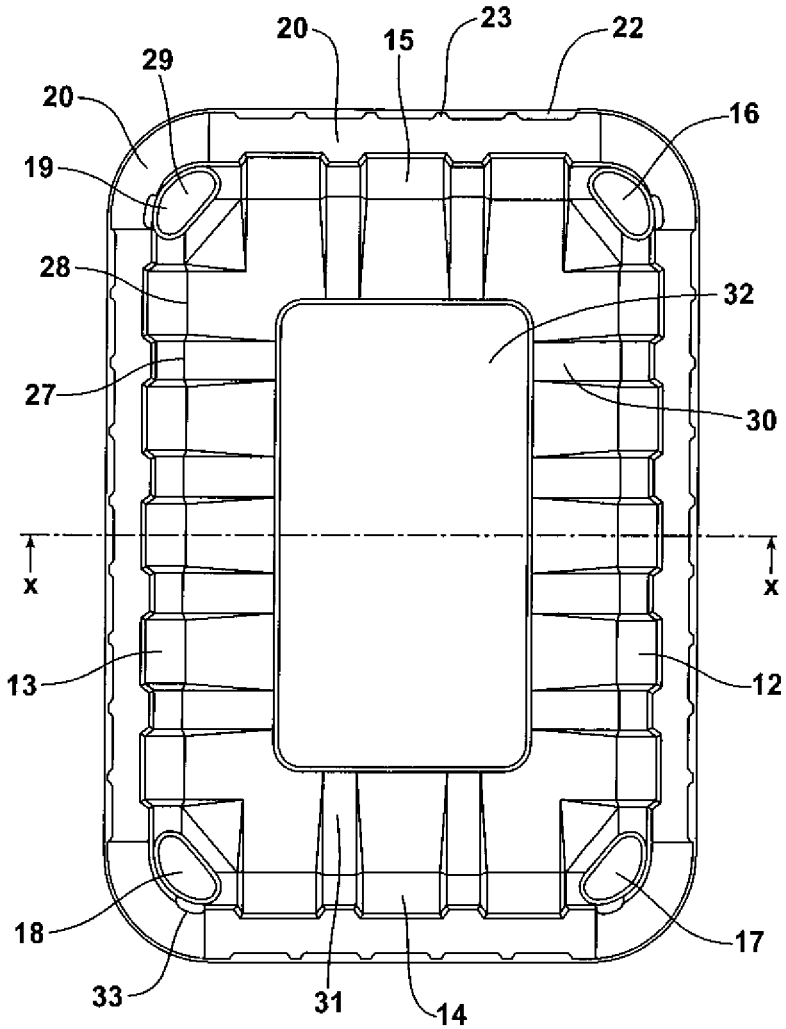
FIG. 3 is a top view of the embodiment of FIG. 1.
Figure 4:
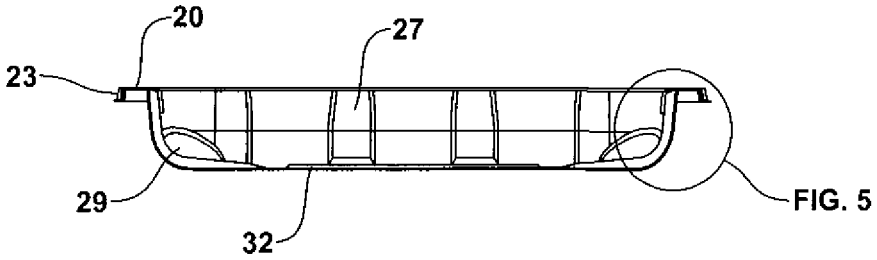
FIG. 4 is a section view (along line X-X) of the tray of FIG. 3.

The rim in the joining corners generally will not comprise any rib 23 and, as illustrated in FIGS. 1 and 3, the width of the primary flange in the joining corners typically corresponds to the width of the primary flange and ribs along the sidewalls.

In a preferred embodiment the tray will also comprise a plurality of vertically arranged ribs 27 that are longitudinally spaced apart along the sidewalls extending inwardly from the base 11 up to the inner edge of the primary flange 20. They can be equally spaced along the sidewalls, as illustrated in FIGS. 1 to 3, or they can be more distant in the middle portion of each sidewalls and closer one to the other in the portions of each sidewalls that are closer to the joining corners. They are typically longer and wider than ribs 23 on the rim. Trays with strengthening ribs in the tray sidewalls are widely known in the art and in the market, and any type of known sidewalls strengthening ribs can be used in connection with the trays according to the present invention. In particular sidewalls strengthening ribs that may be used in the trays according to the present invention may have the same size and shape all along the sidewalls, as illustrated in FIG. 1, or a specific configuration, such as for instance as described in EP-A-1, 600,386.

In general there need to be no correspondence between the ribs 23 in the rim 21 and those in the inner sidewall 27, as their size and number is generally different. Typically therefore they are off-set at the primary flange.

The line indicated in the Figures with the numeral 28 is just a so-called definition line, i.e., a line in the drawings only, that in this case indicates the passage from the sidewalls to the base portion.

The numeral 29 indicates the chamfered corners present in the tray of the embodiment of FIG. 1.

The tray 10 may further comprise (and preferably does comprise) a plurality of strengthening ribs 30, 31, integral with and projecting upwardly from base 11. In FIGS. 1 and 3, one embodiment is illustrated where said ribs 30, 31 extend only partially from the lower edges of the long or short sides across the base 11, decreasing their depth, and leaving a flat unribbed and slightly raised central portion 32. In another embodiment, not illustrated here, strengthening ribs extend also in the central portion 32. This may be obtained e.g., by allowing at least part of the ribs 30 to extend across the base 11 within sides 12 and 13 in a direction generally perpendicular to said sides. Preferably said strengthening ribs 30 extending across the base are perpendicular to the longitudinal sidewalls. Intersecting ribs may be present, by extending at least part of ribs 31 across the base 11, to further increase rigidity of the tray base. The way ribs 31 intersect or approach intersection with ribs 30 provides additional strength to the tray, particularly along the long sides 12 and 13. It is also possible, and these are additional embodiments encompassed by the present invention, that ribs in one direction superpose on the ribs in the perpendicular direction on the tray base 11 or that separated ribs are thermoformed in the central portion 32. Corrugations lines that may be parallel flutes, furrows, ridges, crests or grooves may also be formed in the base 11.

In one embodiment the trays according to the present invention will have depressions 33, designed in the corners of the trays, and projecting inwardly, below the level of the tray primary flange, which will be used as de-nesting features, to allow an easy separation between the trays in the packaging processes. However when the trays of the present invention are formed in a continuous web and then loaded and possibly lidded before separating the end packages one from the other and from the skeleton of the continuous web, obviously the de-nesting feature will not be present as there will be no need therefore.

The material from which the tray according to the present invention can be formed is any thermoplastic material, mono- or multi-layered, capable of being thermoformed, by conventional thermoforming methods. When mono-layer materials are employed, suitable thermoplastic materials that can be used are for instance polypropylene, polyesters, such as polyethylene terephthalate, polyethylene naphthalenate, polylactic acid, etc., polyamides, polystyrene, PVC, and the like materials. Post consumer recycle polyester, in particular post consumer recycle PET, can also be employed. It is also possible to use blends of suitable polymers, particularly when one of the components of the blend is used in a minor amount as an impact modifier to increase flexural modulus and crack resistance of the end tray.

When multi-layered materials are employed, they will typically comprise one or more bulk layers comprising at least one of the above materials, a layer of a sealant, typically including a polyolefin, such as an ethylene or propylene homo- or copolymer, e.g. EVA, a linear ethylene-.alpha.-olefin copolymer, propylene-ethylene-butene terpolymer, etc., possibly a layer comprising a gas-barrier resin, such as EVOH, PVDC, a polyamide, polyglycolic acid, PVOH, and the like resins characterized by an Oxygen Transmission Rate (evaluated by following the method described in ASTM D-3985 and using an OX-TRAN instrument by Mocon) <300 $cm^3$0.25 μm/m.sup$^2$.day.bar at 23° C. and 0% of RH, tie layers to improve the bond between adjacent layers and avoid delamination, possibly other inner layers such as moisture protecting layers, easy opening layers, layers containing particular additives, etc.

In a preferred embodiment the material of the tray or the bulk layer of the tray is polypropylene optionally blended with minor amounts of other resins, typically working as impact modifiers, and/or with conventional additives.

In another preferred embodiment the material of the tray or the bulk layer of the tray is polyethylene terephtalate; and in a most preferred embodiment the material comprises post-consumer recycle polyethylene terephtalate.

The thermoplastic material used for the container of the present invention may be transparent, either clear or colored, translucent, either clear or colored, or opaque. Preferably however, for the reasons indicated above, it will be transparent or translucent.

The sheet used for the manufacture of the trays of the present invention may be obtained by extrusion, and in case of a multilayer sheet by co-extrusion, or by conventional lamination techniques and is then converted into tray 10 by a thermoforming process. This forming step can be carried out off-line, to create pre-made, separated, trays that are then used in the packaging process, or in-line to create trays, joined by the continuous web in which they have been formed, that are loaded with the product to be packaged and suitably closed by lidding before separation of the end packages. In both cases the forming step is carried out using a thermoforming machine. In particular, a forming tool made of two halves is employed that comprises an upper part, so called the pressure box, and a lower one, i.e. the mold. The mold used has a concave, female, portion with a suitably designed inside shape and a male top edge perimeter portion, mating the desired shape for the flanges, the rim, and the ribs of the tray according to the present invention. The heat-softened plastic web is then clamped between the mold and the upper part, and it is drawn down over the mold by drawing a vacuum through the mold, and at the same time injecting pressurized air from above the plastic web. The process may run with or without the assistance of a suitable plug. During the entire thermoforming cycle, the whole surface of the mold (sidewalls, base, corners and top flange areas) is cooled by chilled water circulating within the metal body of the mold.

In case of pre-made trays the last step, which may be carried out directly in the mold or in a separate station, is the cutting of the trays from the plastic web and their nesting for suitable transportation.

In case of trays made in-line with the packaging process, the plastic web with the trays formed therein is moved to a loading station and then to a station where the package is closed, that can be of a different type depending on the particular packaging process applied.

The thickness of the sheet, used as starting material in the above described thermoforming processes, would be generally within the range of from about 300 μm to about 1,000 μm, preferably from about 350 μm to about 900 μm, even more preferably from about 400 μm to about 800 μm, and yet more preferably from about 450 μm to about 700 μm, mainly depending on the depth of the tray which is desired. The depth (or height) of the thermoformed trays of the present invention is generally up to 120 mm, e.g., up to 110 mm, 100 mm, 90 mm, 80 mm, 70 mm, 60 mm, or 50 mm.

A second object of the present invention is a package comprising a thermoformed solid tray as described above, a product, particularly a food product, loaded therein, and a lidding film, or a suitable combination of lidding films, closing the package hermetically.

The product can be packaged under vacuum and in that case the lidding film will preferably be draped down over the product, following the product contour, and sealed to the tray base, sidewalls, and flange, wherever the product is not present, in a typical VSP configuration. If desired then a flat lid sealed only in correspondence with the tray flange may be present to improve the package appearance and function as support for any product information or/and keep a suitable preserving gas in the space over the first skin lid thus delimited. Alternatively the product can be packaged in air or preferably in a modified atmosphere suitably selected to prolong or improve the shelf-life of the packaged product. In such a case the lidding film is preferably positioned over the product and sealed to the tray flange only. It can be a single lidding film, with oxygen-barrier properties if the product is packaged in a modified atmosphere, or a combination of an innermost (i.e. closer to the food product) oxygen-permeable film (e.g., a film with an OTR evaluated as indicated above for the oxygen-barrier layers of at least 500 $cm^3$0.25 $\mu m/m^2$.day.bar) with an outermost oxygen-barrier film, as described in EP-A-690,012 and WO 2006/087125, both documents being incorporated herein by reference.

In one embodiment the lidding film is a heat-shrinkable film or, in case of a combination of two lidding films, at least one of them, and preferably both, are heat-shrinkable. For this application, heat-shrinkable film is a film which has been bi-axially oriented and possibly annealed, that shrinks by at least 2%, preferably at least 3% and more preferably at least 5% in each direction at the temperature which is reached within the chamber during the sealing step. Depending on the packaging machines, and the sealing conditions set, said temperature is typically comprised between about 50 and about 90° C., generally between 60 and 80° C. Preferably, at the temperature reached within the chamber during the sealing step, said heat-shrinkable film(s) will have a shrink force lower than 0.1 kg/cm, preferably lower than 0.09 kg/cm and even more preferably lower than 0.08 kg/cm. Even more preferably, at the temperature reached within the chamber during the sealing step, said heat-shrinkable film(s) will have a shrink force in the transverse direction (TD) lower than 0.07 kg/cm, preferably lower than 0.06 kg/cm and even more preferably lower than 0.05 kg/cm.

Suitable lidding films, to be used singly or in combination, include however also non oriented films as well as oriented and heat-set films.

The lidding films may be mono- or, preferably, multi-layer films. If mono-layer, they will typically comprise polyolefins or polyesters. If multi-layer, they will typically comprise a sealant outer layer, generally comprising a polyolefin or a resin suitable for sealing to the outer surface of the tray, an oxygen-barrier layer if an oxygen-barrier film is required, an outer abuse-resistant layer, and tie layers to improve the adhesion between the different layers. Other layers may however be present as known in the art and additives can be present in the various layers as conventional in this field. Typical thickness for the lidding films, or each of the lidding films in case a combination of two films is used, is between about 12 and about 50 μm, preferably comprised between 13 and 40 μm and more preferably between 14 and 35 μm.

A specific preferred embodiment of said second object of the present invention is a package comprising a solid thermoformed plastic tray which is provided with a base, a plurality of sidewalls extending upwardly and slightly outwardly from said base, a primary flange integrally joined to the upper edges of the sidewalls and extending outwardly all around the upper periphery of the sidewalls, a rim extending downwardly and tapering slightly outwardly from the outer periphery of the primary flange and bearing a plurality of strengthening ribs extending substantially vertically and outwardly with respect to the tray body, and a secondary flange, extending outwardly from the lower edge of the rim, a fresh meat product loaded therein, and a combination of an innermost oxygen-permeable film and an outermost oxygen-barrier film closing the package under a high oxygen-content atmosphere.

Figure 6:
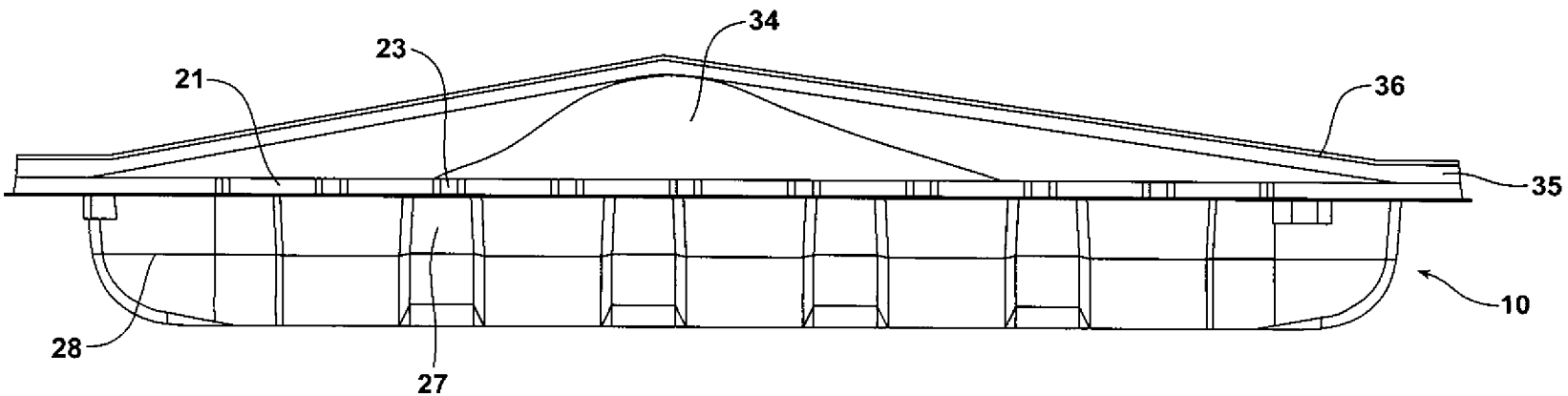
FIG. 6 represents a schematic view of a package where a product is loaded into a tray according to one embodiment of the present invention and the package is closed by a combination of two lidding films.

This embodiment is schematically illustrated in FIG. 6, where 34 indicates the product packaged within tray 10, 35 is the innermost oxygen permeable film and 36 is the outermost oxygen-barrier lidding film.

Preferably in said embodiment at least one of the innermost oxygen-permeable film and the outermost oxygen-barrier film closing the package, and more preferably both films, are heat-shrinkable.

Another specific object of the present invention is a packaging process where a solid plastic tray of the first object is thermoformed in-line in a continuous web of thermoplastic material, the product to be packaged is then loaded into the formed tray while still part of the continuous web, the tray is closed by a lidding film or by a suitable combination of lidding films, with or without prior modification of the atmosphere in the space between the tray and the lidding film, and the end packages are then separated by cutting through the continuous webs.

As indicated above the presence of ribs on the tray rim has a remarkable stiffening effect on the tray flange. This reflects into a markedly improved resistance of the tray to deformation and bending, what favorably affects the hermeticity of the end package.

A test method has been set up to evaluate the stiffening effects of the ribs 23 on the tray flange and how the presence of these ribs can prevent the distortion of the flange that may be observed with conventional solid trays e.g., when a heat-shrinkable lidding film or a combination of an oxygen-permeable and an oxygen-barrier heat-shrinkable films is employed for lidding. In this test, a metal plate is set in place of the bottom jaw of a dynamometer, taking care of centering said plate in correspondence with the upper jaw axis. A tray is then positioned in the center of the metal plate, laying thereon on its base, and it is heavily loaded inside (3.15 kg). Two small spring clips are set to clasp the flange of the tray at the middle of the longitudinal sidewalls, pinching the flange at half its width. A first thread, that would then connect the outermost upper portions of the two clips, is first inserted into the end eye of a second thread which is connected to the upper jaw of the dynamometer. Said second thread is then set in traction, through the upper jaw, with a pre-load of 20 g. The length of the first thread is chosen in such a way that the traction angle between said thread and the tray flange, once the second thread is set in traction, is as close as possible to 45 degrees. The test is run by pulling upwardly the second thread by a fixed distance (2 cm in our tests) at a fixed and fairly high speed (1 m/min in our case) and recording the maximum load peak. The higher is the value recorded, and the higher is the resistance of the flange to distortion. Trays of identical dimensions (260 mm×155 mm×50 mm), made of the same material, and having essentially the same shape but differing in the presence or absence of ribs on the rim, have been submitted to this test. More particularly Trays A and B have been compared with Comparative Trays C, where Comparative Trays C had no ribs on the rim, and both Trays A and B had 12 ribs on each of the long sidewalls and 6 ribs on each of the short sidewalls, positioned at the same distance one from the other in both trays, with the same thickness but a different width (0.8 cm for Trays A and 0.5 cm for Trays B). The tests were repeated on twelve trays for each group and the results (in g) are reported in Table I below:

TABLE I

| | Trays A | Trays B | Comparative Trays C |
|---|---|---|---|
| Min | 321 | 329 | 270 |
| Avg | 335 | 348 | 283 |
| Max | 345 | 370 | 293 |

The resistance to deformation of the trays according to the present invention has also a remarkable effect on the hermeticity of the packages which are obtained therewith. In particular this effect has been shown by evaluating the possible presence of leakers, through the heat-seal area, in packages obtained by lidding, under identical conditions, conventional solid trays or trays according to the present invention and differing from the comparative ones only for the presence of ribs along the rim. To run this test modified atmosphere packages were made in an automatic lidding machine (a Mondini Evolution machine) set in exactly the same manner for all the samples (same sealing temperature, sealing time, vacuum level, vacuum time, gas level, and gas time) using trays according to the present invention and, for comparative purposes, conventional solid trays differing from the trays of the present invention for the absence of ribs along the rim. The end packages were immersed, one at a time, in a water filled transparent plastic container. The container was closed, vacuum was then switched on and note was taken of the vacuum level at which the first bubbles escaping from the seal appeared. Generally speaking the adhesion of a lid to a tray is considered to be acceptable if no leakers, thus no bubble emission, are observed under an average vacuum level of 0.4 bar corresponding to a pressure of 0.6 bar. In this test 20 packages for each group have been tested and while on the average the Comparative Trays showed bubble emission even before reaching the 0.4 bar vacuum level, with Trays A and Tray B it was possible also to go to a vacuum level higher than 0.4 bar (corresponding to a pressure lower than 0.6 bar).

What is claimed is:

1. A package comprising:

a. a solid thermoformed plastic tray comprising:

i. a base, wherein said base is substantially rectangular in shape;

ii. a plurality of sidewalls extending upwardly and slightly outwardly from said base;

iii. a primary flange integrally joined to the upper edges of the sidewalls and extending outwardly around the upper periphery of the sidewalls;

iv. a rim comprising a flap extending downwardly and tapering slightly outwardly from the outer periphery of the primary flange; and v. a secondary flange comprising an overhanging portion extending outwardly from the lower edge of the rim;

b. a product loaded in said tray;

c. a lidding film sealed to said tray to enclose said product;

wherein said tray comprises a plurality of ribs extending substantially vertically along said rim and outwardly from the tray body, extending from the primary flange to the secondary flange.

2. The package of claim 1, wherein said lidding film is sealed to said tray flange.

3. The package of claim 1, wherein said lidding film is heat shrinkable.

4. The package of claim 1, wherein said lidding film comprises a combination of an innermost oxygen permeable film and an outermost oxygen barrier film.

5. The package of claim 4, wherein at least one of said innermost and outermost films is heat shrinkable.

6. The package of claim 1, wherein said lidding film has oxygen barrier properties.

7. The package of claim 1, wherein said product is a fresh meat product.

8. The package of claim 1, wherein the angle between the primary flange and the rim is between 75 and 90 degrees.

9. The package of claim 1, wherein the tray sidewalls taper outwardly from the base at an angle of up to 7 degrees.

10. The package of claim 1, wherein the primary flange and the secondary flange are parallel to each other.

11. The package of claim 1, wherein said ribs are in the shape of a trapezoid.

12. The package of claim 1, wherein the tray comprises rounded corners in the areas of junction between two consecutive sidewalls.

13. The package of claim 1, wherein said package is a vacuum skin package.

14. The package of claim 1, wherein said package is a modified atmosphere package.

15. The package of claim 1, wherein said tray further comprises a plurality of sidewall ribs disposed and longitudinally spaced along the tray sidewalls and extending inward from the base up to the inner edge of the primary flange.

16. The package of claim 15, wherein the sidewall ribs are even in number on each sidewall and symmetrically positioned with respect to the median line thereof.

17. The package of claim 1, wherein said tray is monolayered or multilayered and comprises at least one bulk layer comprising polypropylene, polyester, polyamide, polystyrene, polyvinyl chloride, or combinations thereof.

18. The package of claim 1, wherein said tray is transparent.

* * * * *